United States Patent [19]

Sedley et al.

[11] 4,133,194

[45] Jan. 9, 1979

[54] MAGNETIC KEY OPERATED DOOR LOCK

[75] Inventors: Bruce S. Sedley, R.R. 1 Box 96, Koloa, Hi. 96756; Howard M. Allenbaugh, Gardena, Calif.

[73] Assignee: Bruce S. Sedley, Koloa, Hi.

[21] Appl. No.: 746,705

[22] Filed: Dec. 2, 1976

[51] Int. Cl.[2] ..... E05B 13/10; E05B 47/00

[52] U.S. Cl. ..... 70/222; 70/218; 70/276; 70/413

[58] Field of Search ..... 70/218, 221, 276, 387, 70/413, 416, 422, 1.5, 222, 224, 277

[56] References Cited

U.S. PATENT DOCUMENTS

| | | | |
|---|---|---|---|
| 2,019,262 | 10/1935 | Kauffman | 70/413 X |
| 2,049,742 | 8/1936 | Lowe | 70/422 X |
| 2,732,703 | 1/1956 | Noregaard | 70/276 X |
| 2,931,953 | 4/1960 | Barney | 70/387 X |
| 3,096,114 | 7/1963 | Trammell | 70/218 X |
| 3,234,767 | 2/1966 | Allander | 70/276 |
| 3,266,278 | 8/1966 | Ennitt | 70/277 |
| 3,421,348 | 1/1969 | Hallmann | 70/276 |
| 3,584,484 | 6/1971 | Hallmann et al. | 70/218 X |
| 3,705,277 | 12/1972 | Sedley | 70/276 X |
| 3,995,460 | 12/1976 | Sedley | 70/276 X |

*Primary Examiner*—Rodney H. Bonck
*Attorney, Agent, or Firm*—Gordon Wood

[57] ABSTRACT

A door lock structure adapted to be actuated by a magnetic card key to operate a conventional cylindrical door lock with substantially no modification to such lock. A housing containing the magnetically operated elements of the lock is mounted, along with a modified knob, on the conventional spindle of the lockset in lieu of the usual door knob. The housing is freely rotatable relative to the lockset spindle to prevent wrenching. The latchbolt retractor of the lockset is actuated in the normal manner to unlock the lockset by rotating a conventional driver bar. The driver bar in this structure is rotated by registering interengaging elements carried by the driver bar and a slide which is actuated by a properly coded magnetic card key. The modified knob may be freely rotatable on the spindle or may be fixed thereto.

7 Claims, 5 Drawing Figures

MAGNETIC KEY OPERATED DOOR LOCK

This invention relates to a lock structure operated by a magnetic card key and which structure is adapted to be employed with a conventional door lock having therein the usual latchbolt retracting mechanism and a rotatable driver bar for translating the retractor mechanism to retract the bolt. The main object of the present invention is the provision of a magnetic card key actuated lock adapted to be employed with a conventional outside door knob with no modification of the knob structure or deadbolt.

In some respects the present invention is similar to that disclosed in application Ser. No. 582,125, filed May 30, 1975 now U.S. Pat. No. 3,995,460, to which reference is made for details not disclosed herein. Said patent is owned by Bruce Sedley, owner of the instant application. The present invention is, in some respects, an improvement over the structure disclosed in said copending application.

Another object of the invention is the provision of a magnetic card key operated locking device which may be incorporated in a conventional cylinder lock in the field, and marketed as a replacement part for door knob locksets.

A further object of the invention is the provision of a novel means for rotating the driver bar to retract the latchbolt by one having a properly coded card key.

Still another object of the invention is the provision of a housing by means of which the driver bar is rotated through the use of a properly coded card key but which housing is freely rotatable in its locked condition so as to prevent unauthorized opening of the lockset by wrenching — that is, by applying an inordinately heavy torque to the structure.

Another object of the invention is the provision of a magnetic card key receiving housing and a modified knob structure wherein the housing and the modified knob are freely rotatable with respect to the lockset spindle to reduce the likelihood of unauthorized opening of the lockset. In this connection the invention provides, alternatively, for securing the modified knob to the lockset spindle to permit opening the unlocked lockset by means of the modified knob only.

Other objects and advantages of the invention will be apparent from the following specification and from the drawings.

Figures 1, 2, 3, 4, 5:
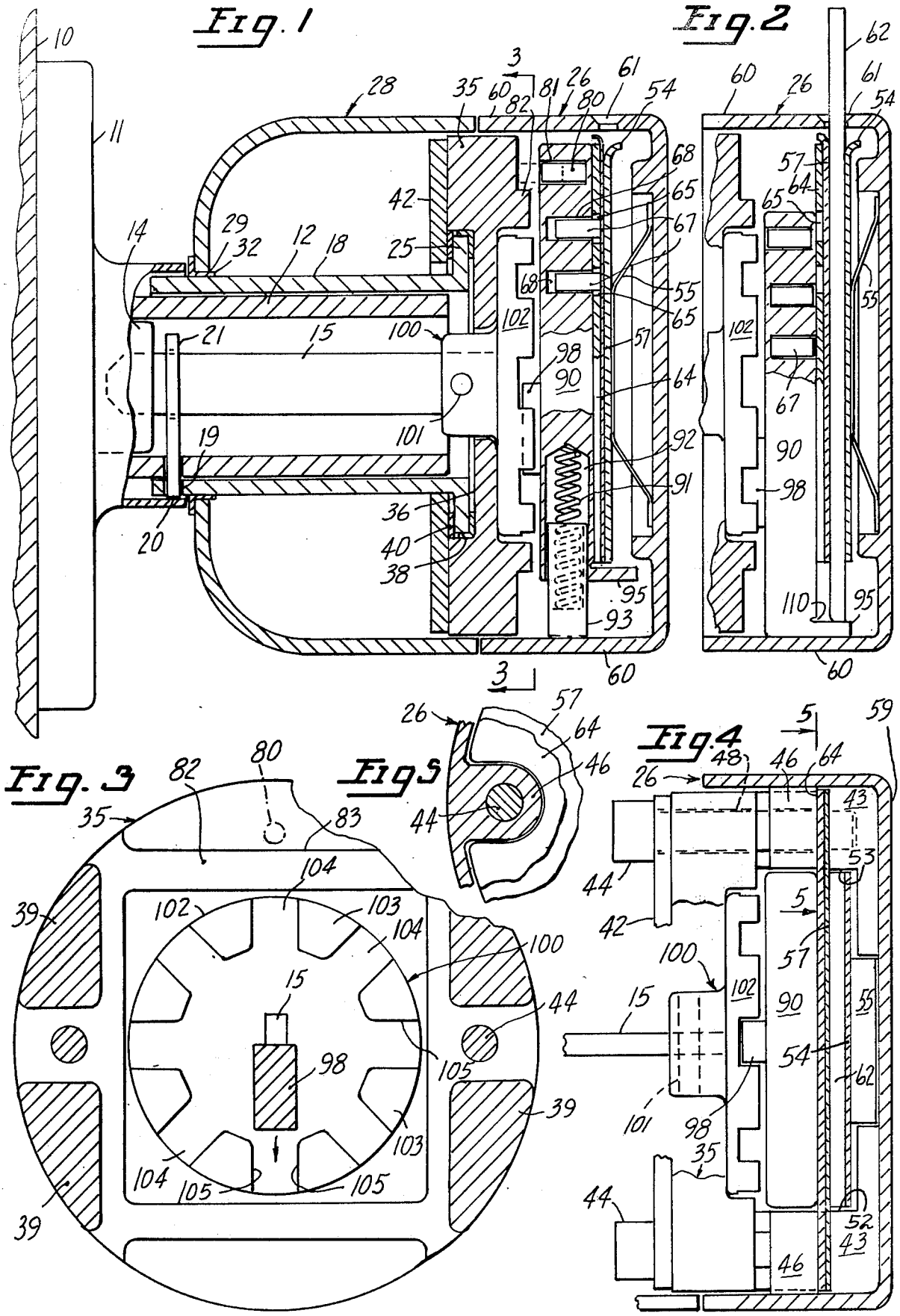
FIG. 1 is a vertical cross section through the knob spindle of a conventional door lock showing the invention mounted thereon in locked condition.
FIG. 2 is a fragmentary view similar to FIG. 1 showing the invention in unlocked condition.
FIG. 3 is a cross sectional view taken in a plane indicated by lines 3—3 of FIG. 1 and showing the means for interconnecting the slide and the driver member.
FIG. 4 is a view similar to FIG. 2 but taken in a plane at right angles thereto.
FIG. 5 is a fragmentary sectional view taken in a plane indicated by lines 5—5 of FIG. 4.

In detail the invention is adapted to be employed with a conventional door lock structure mounted on a door 10 and which lock structure includes an escutcheon plate 11 through which is received a spindle 12 to which the conventional knob is usually secured. The lockset structure also includes a rotatable member 14 associated with the retracting mechanism of the lock and which member is rotated to unlock the lockset by rotation of a driver bar 15. In the conventional lockset the driver bar

15 is connected to the rotatable plug which is rotated by means of a proper metal key inserted in the keyway. By the present invention the driver bar 15 is similar to the corresponding conventional driver bar but is rotated in a manner to be described.

Mounted on spindle 12 is a sleeve 18 which is formed with an opening 19 adapted to receive therethrough a projection 20 on a conventional knob catch 21 carried by spindle 12. The sleeve 18 is secured to the spindle 12 by said knob catch in the conventional manner. As is well known in the art, the knob catch 21 is urged into slot 19 by a flat spring (not shown) and, when the lockset is in unlocked condition the knob catch may be depressed in spindle 12 to permit removal of sleeve 18. Said knob catch performs no part of the present invention except in combination with the structure to be disclosed. The outer end of sleeve 18 is formed to provide a radially extending flange 25 on which is rotatably mounted a housing generally designated 26. Between the housing 26 and the door 10 there is provided a modified knob 28 conforming in shape to a portion of a conventional knob and provided with a central aperture 29 for receiving the sleeve 18 therethrough. A washer 32 may be interposed between the wall of aperture 29 and sleeve 18 to facilitate rotatably supporting said modified knob 28 on sleeve 18.

The housing 26 includes a relatively thick plate 35 which is provided with a large central circular recess 36 receiving the flange 25 of sleeve 18 therein (FIG. 1). Interposed between the outer end of flange 25 and the bottom of recess 36 is an antifriction washer 38 and on the opposite side of washer 38 is another washer 40 engaging the inner face of flange 25.

The plate 35 is rotatably secured on flange 25 by means of an inner clamping plate 42 which is provided with a pair of apertures through which extend securing bolts 44 (FIG. 4). The housing 26 is formed to provide a pair of radially inwardly projecting bosses 43 into which the bolts 44 are threadedly secured. The plate 35 is formed with bosses 39 and is provided with apertures 48 for receiving the shanks of bolts 44 therethrough so that the plate 35 is clamped in a fixed position relative to housing 26.

The housing 26 includes a cylindrical sidewall 60 and an end wall 59 on which are formed the bosses 43 which define at their inner sides a pair of opposed parallel side walls 52, 53 (FIG. 4) between which is provided a shield plate 54 of steel or other magnetizable material. Said plate 54 is yieldably urged inwardly of the structure by means of a flat spring 55. Alongside shield plate 54 is a cover plate of nonmagnetic material, such as stainless steel, and indicated at 57. The cylindrical sidewall 60 of housing 26 is provided with a slot 61 which is adapted to receive therethrough a card key indicated at 62. When the card key 62 is inserted in the slot it urges the shield plate 54 outwardly toward end wall 59 against the urgency of spring 55 as best seen in FIG. 2.

Inwardly of cover plate 57 is a locking plate 64 which is provided with a plurality of apertures 65 as disclosed in greater detail in the above noted copending application. Said apertures 65 are adapted to receive therein one end of one or more locking magnets indicated at 67. Plates 57, 64 are shaped so as to be held in place by bosses 46, integral with bosses 43 (FIG. 5).

The cover plate 57 and locking plate 64 are clamped along their outer marginal portions between bosses 39 and bosses 43 at assembly by bolts 44.

Said locking magnets 67 are contained within outwardly opening recesses 68 in a slide 90 which is positioned alongside the locking plate 64. This slide 90 is normally urged upwardly to the position shown in FIG. 1 by means of a nonmagnetic compression spring 91 received in an outwardly opening bore 92 on one end of slide 90 with the outer end of said sprig 91 being received in a plunger 93 bearing at its outer end against the inner side of cylindrical sidewall 60 of housing 26. Slide 90 is provided with an offset flange 95 engageable by the inner end of the card 62 At this point it will be noted that the magnets 67 are normally urged into locking position in holes 65 of locking plate 64 because of the magnetic attraction to the steel shield plate 54. However, when card 62 is inserted in the housing 26 so as to move slide 90 to the position shown in FIG. 2 the magnets 67 are first repelled by predetermined magnetic spots on the card into the recesses 68 so as to unlock the slide 90 ad permit the same to be urged against the inner side of housing 26 as shown in FIG. 2.

On the side of slide 90 opposite the flange 95 there is provided an integral rectangular projection 98 which is adapted to cooperate with a member generally designated 100 which is fixedly secured to the outer end of driver bar 15 by means of a pin 101. The cooperation between projection 98 and member 100 is best shown in FIG. 3 wherein it is seen that the member 100 includes a circular plate 102 which is formed with a plurality of axially extending trapezoidal shaped teeth 103 which are formed so as to provide a plurality of radially extending slots 104. When the slide 90 is moved toward its unlocking position of FIG. 2 it enters one of said slots 104 so that upon rotation of housing 26 the member 100 and the driver bar attached thereto are rotated to unlock the lockset. It should be noted in FIG. 3 that the teeth 103 in effect provide shoulders 105 and it is one of said shoulders which cooperates with projection 98 as an abutment to permit rotating the member 100 and driver bar 15 in the unlocking direction. Since the housing 26 is rotatable at all times it will be apparent that only one such shoulder 105 is required to effect unlocking. However, it has been found that the structure of FIG. 3 insures that the projection 98 enters one of the slots 104 so that there is a minimum amount of lost motion in a circumferential direction between the projection 98 and the shoulder that it engages.

An antirap device is incorporated in the present invention for the purpose of preventing release of the locking magnets 67 by applying an impact to the end wall 59 to retract said magnets out of locking plate 64. Such antirap device includes an antirap magnet 80 which is normally held by the attraction of plate 54 within a recess 81 opening outwardly of the opposite side of slide 90 from recesses 68. The heavy plate 35 is formed with a rib 82 providing a shoulder 83 (FIG. 3) which is adapted to abut magnet 80 when the latter is in its outer position shown in dotted lines in FIG. 1. Thus, if the housing 26 is impacted to move the magnet 80 to its outer position, downward movement of slide 90 is prevented.

If it is desired not to have the modified knob 28 free spinning on spindle 12 said modified knob may be secured to said spindle in any desired manner.

It will be noted that the provision of eight slots 104 (FIG. 3) allows the insertion of the card through card slot 61 at numerous points so that the unit does not need to be made especially for left or right hand use.

In order to prevent circumvention of the lock by forcing a tool through card slot 61 and applying an inordinate force on flange 95 of slide 90 the juncture between said flange 95 and the main body portion of slide 90 may be weakened by providing a groove 110 (FIG. 2) so as to insure that the flange 95 breaks off before the locking magnets 67 fail.

The steel plate 54 not only performs the function of attracting the locking magnets 67 to their locking position but also prevents one from discerning the code of the lock by applying a detector to outer wall 59. In addition, the plate 54 in cooperation with cover plate 57 prevents foreign material from entering the device.

I claim:

1. In a magnetic key actuated lock structure, a housing, a planar slide in said housing adapted to be translated from a locked position to an unlocking position by a magnetically coded card key inserted in said housing, magnetic pins in said slide and slidable transversely thereof, a locking plate alongside said slide and provided with apertures for receiving said pins therein when said structure is in locked condition, a cover plate positioned alongside said locking plate and adapted to be engaged by said pins when the latter are in locked position, a shield plate alongside and outwardly of said cover plate and positioned in said housing to permit said card key to be inserted between said shield plate and cover plate, and spring means for urging said shield plate toward said one face at all times to enhance the magnetic effect of said card key.

2. A lock structure according to claim 1 wherein said card key is in face to face relation along its opposite sides with said shield plate and cover plate when so inserted in said housing.

3. In a lock structure having means for unlocking the same and wherein said means includes a member adapted to be rotated about an axis for so unlocking said structure, a housing rotatably supported on said structure, a slide in said housing in face to face relation relative to said member and mounted for sliding movement radially of said axis, said member and said slide being formed with interengaging elements, means in said housing preventing relative rotational movement of said slide and housing and permitting sliding movement of said slide from a normal locking position with said elements out of engagement to an unlocking position with said elements in engagement for connecting said member and slide together for rotating said unlocking member upon rotation of said housing, said housing being formed with an opening permitting the insertion of a magnetic card key therethrough in said radial direction for pushing said slide to unlocking position, a locking magnet in said slide normally holding said slide fixed relative to said housing and movable to an unlocking position under the influence of such card key to allow said sliding movement of said slide.

4. A lock structure according to claim 3 wherein said interengaging elements comprise an axially outwardly projecting shoulder on said member and a projection on said slide in registration with said shoulder when said slide is in unlocking position.

5. A lock structure according to claim 3 wherein said interengaging elements comprise a circular row of radially inwardly opening recesses on said member and a projection extending outwardly of said slide and adapted to enter one of said recesses when said slide is moved perpendicular to said axis to said unlocking position.

6. A lock structure according to claim 3 wherein said lock structure includes a knob spindle, said housing being rotatably mounted on said knob spindle whereby, in its normal locking condition, said housing is freely rotatable on said spindle.

7. A lock structure according to claim 3 wherein said lock structure is mounted on a door, a knob member rotatably supported on said structure and interposed between said housing and said door whereby wrenching of said structure is prevented.

* * * * *

UNITED STATES PATENT OFFICE

CERTIFICATE OF CORRECTION

Patent No. 4,133,194 Dated January 9, 1979

Inventor(s) Bruce S. Sedley and Howard M. Allenbaugh

It is certified that error appears in the above-identified patent and that said Letters Patent are hereby corrected as shown below:

In claim 1, at line 29 of col. 4, after "outwardly of" insert ---one face of---.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*